US008198572B1

(12) United States Patent
Geswender et al.

(10) Patent No.: US 8,198,572 B1
(45) Date of Patent: Jun. 12, 2012

(54) SELF CLOCKING FOR DISTRIBUTED PROJECTILE GUIDANCE

(75) Inventors: Chris E. Geswender, Green Valley, AZ (US); Stephen E. Bennett, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 316 days.

(21) Appl. No.: 12/477,183

(22) Filed: Jun. 3, 2009

(51) Int. Cl.
*F42B 15/01* (2006.01)
*F41G 9/00* (2006.01)
*F42B 15/00* (2006.01)

(52) U.S. Cl. ..... 244/3.21; 244/3.1; 244/3.15; 244/3.23; 102/501

(58) Field of Classification Search ..... 244/3.1–3.3; 102/382, 384, 473, 501; 342/59, 61, 62, 342/63; 701/1, 3–18, 200, 222, 223; 396/7
See application file for complete search history.

(56) References Cited

U.S. PATENT DOCUMENTS

| | | | | | |
|---|---|---|---|---|---|
| 2,740,961 | A | * | 4/1956 | Slater | 342/61 |
| 3,095,562 | A | * | 6/1963 | Dworetzky et al. | 342/61 |
| 3,184,736 | A | * | 5/1965 | Badewitz | 342/63 |
| 3,210,760 | A | * | 10/1965 | Olson et al. | 342/59 |
| 3,352,223 | A | * | 11/1967 | Garra | 396/7 |
| 3,362,657 | A | * | 1/1968 | McDaniel | 244/3.19 |
| 3,472,471 | A | * | 10/1969 | Badewitz | 342/62 |
| 3,640,628 | A | * | 2/1972 | Jones | 244/3.16 |
| 3,731,543 | A | | 5/1973 | Gates | |
| 4,160,974 | A | * | 7/1979 | Stavis | 342/63 |
| 4,162,052 | A | * | 7/1979 | Lamelot | 244/3.16 |
| 4,231,533 | A | * | 11/1980 | Durig | 244/3.16 |
| 4,325,066 | A | * | 4/1982 | Grettenberg | 342/61 |
| 4,405,986 | A | * | 9/1983 | Gray | 701/4 |
| 5,245,909 | A | | 9/1993 | Corrigan et al. | |
| 5,259,570 | A | * | 11/1993 | Sochard | 244/3.16 |
| 5,379,968 | A | | 1/1995 | Grosso | |
| 7,079,944 | B2 | * | 7/2006 | Litchfield et al. | 701/222 |
| 2007/0023567 | A1 | | 2/2007 | Lindquist et al. | |

FOREIGN PATENT DOCUMENTS

| | | | | |
|---|---|---|---|---|
| FR | 2657690 | A1 * | 8/1991 | 244/3.21 |
| FR | 2897715 | A1 | 8/2007 | |

* cited by examiner

*Primary Examiner* — Bernarr Gregory
(74) *Attorney, Agent, or Firm* — Renner, Otto, Boisselle & Sklar, LLP

(57) ABSTRACT

A projectile has a pair of different parts with respective orientation sensors for detecting orientation, such as the roll position of the parts. The orientation sensors may be any of a variety of sensors, such as magnetometers, light sensors, infrared (IR) sensors, or ultraviolet (UV) sensors. Orientation events of the orientation sensors, such as maxima or minima of sensor output, are determined. The orientation events of the two sensors are compared to produce an alignment correction factor for correcting for misalignment of the parts relative to one another, that is to correct for differences in alignment between the sensors of the two parts. This allows (for example) instructions produced at one of the parts to be usable at the other of the parts.

19 Claims, 3 Drawing Sheets

SELF CLOCKING FOR DISTRIBUTED PROJECTILE GUIDANCE

BACKGROUND OF THE INVENTION

1. Technical Field of the Invention

The invention is in the field of projectiles with control and guidance systems.

2. Description of the Related Art

Prior projectile systems with multiple sections have relied upon physical alignment of the systems to ensure that different systems are clocked to one another, so as to assure the roll alignment between different parts of systems. Physical alignment has relied upon certain types of physical couplings, such as keyed couplings, and upon use of mechanisms such as physical sighting and upon devices such as shims. Such processes may be time consuming and difficult to perform. It will be appreciated that it would be desirable for improvements in such aspects of projectiles.

SUMMARY OF THE INVENTION

In order to increase flexibility in providing guidance to a number of existing weapon projectiles, guidance with separate guidance and control systems has been envisioned. It would maximize the reuse of existing components if such systems could be made separate. Further, it would make coupling the sections easier if a threaded connection could be used for the coupling.

Instead of the prior physical clocking utilized in combining parts of a projectile, as aspect of the present invention utilizes logical clocking. In physical clocking it is necessary to physically align parts of the projectile to allow a single roll reference from one part to be taken as the same roll reference for the entire projectile. In logical clocking, on the other hand, sensors in different of the parts communicate (either explicitly or implicitly) with one another to determine an alignment correction factor which can be used to translate values from a sensor in one part to a sensor in another part.

According to an aspect of the invention, a method of projectile configuration and use includes: providing a first part of a projectile with a first sensor; providing a second part of the projectile with a second sensor; communicating orientation information from the first part to the second part; and determining, in the second part, an alignment correction factor for correcting for a difference in alignment between the first part and the second part.

According to another aspect of the invention, a projectile includes: a first part of a projectile with a first sensor; a second part of the projectile with a second sensor; a communication link for communicating orientation information from the first part to the second part; and determining, in the second part, an alignment correction factor for correcting for a difference in alignment between the first part and the second part.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various features of the invention.

DETAILED DESCRIPTION

A projectile has a pair of different parts with respective orientation sensors for detecting orientation, such as the roll position of the parts. The orientation sensors may be any of a variety of sensors, such as magnetometers, light sensors, infrared (IR) sensors, or ultraviolet (UV) sensors. Orientation events of the orientation sensors, such as maxima or minima of sensor output, are determined. The orientation events of the two sensors are compared to produce an alignment correction factor for correcting for misalignment of the parts relative to one another, that is to correct for differences in alignment between the sensors of the two parts. This allows (for example) instructions produced at one of the parts to be usable at the other of the parts.

Figure 1:
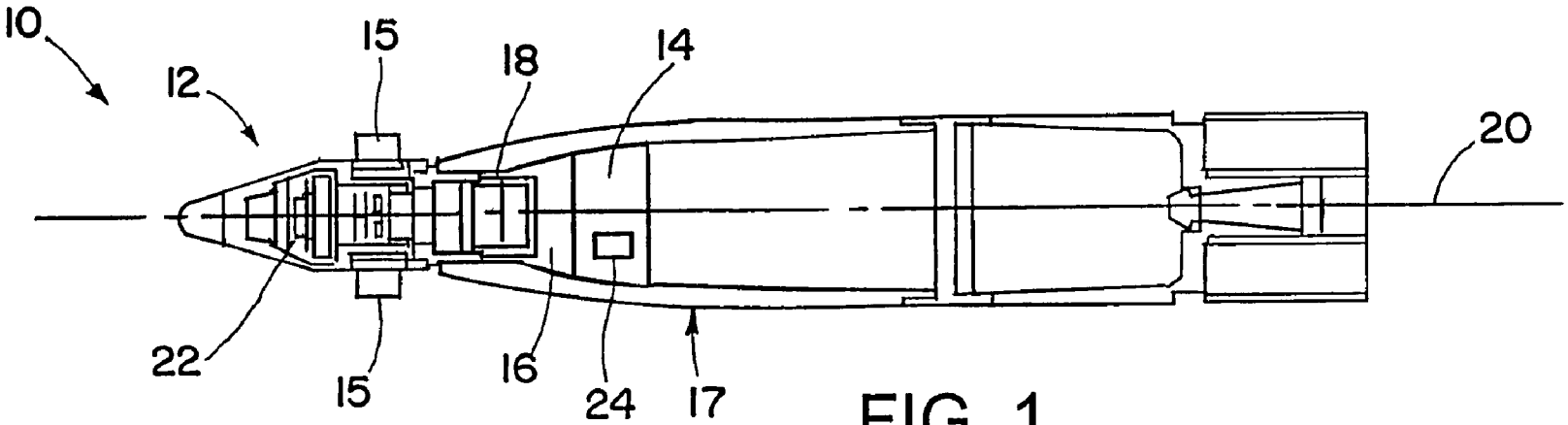
FIG. 1 is a cross-sectional side view of a projectile in accordance with an embodiment of the invention.
Figure 2:
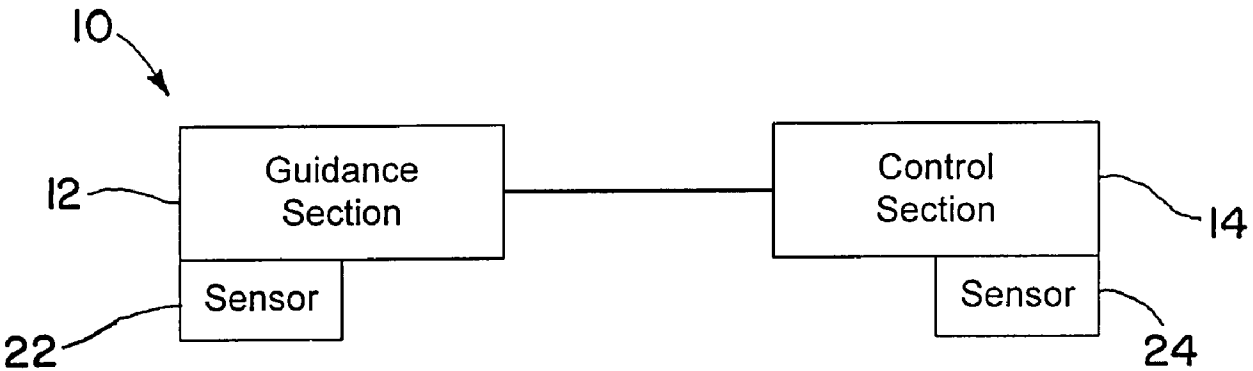
FIG. 2 is a schematic diagram of part of the projectile of FIG. 1.

FIGS. 1 and 2 shows a projectile 10 with a pair of parts, a guidance section 12 and a control section 14. The control section 14 is the part of the system that provides the instructions to guide the projectile 10 on an intended path and/or toward an intended target. The guidance section 12 acts on instructions provided by the control section 14 to alter or maintain the course of the projectile 10. The guidance section 12 may include control surfaces (such as canards or fins) that extend into the airstream around the projectile 10 and produce aerodynamic forces that steer the projectile 10. Another alternative is for the guidance section 12 to provide thrust to control the course of the projectile 10, such as by diverting intake air or by expelling pressurized gases in a direction or directions offset from the longitudinal axis of the projectile 10.

In the illustrated embodiment the projectile 10 has an intervening fuselage portion 16 between the guidance section 12 and the control section 14, with the guidance section 12 forward of the control section 14. However it will be appreciated that many other configurations are possible. For example the guidance section 12 may be aft of the control section 14. As another alternative the sections 12 and 14 may be in contact with one another, without any intervening fuselage portion 16.

One or the other of the sections 12 and 14 may be a part of or within the main fuselage of the projectile 10. For example the control section 14 may be an integral part of the fuselage of the projectile 10, and the guidance section 12 may be a screw-in component, coupled to the fuselage using a threaded connection 18. The guidance section 12 may be part of a multiple purpose guidance kit that has control surfaces which require a controlled roll angle or knowledge of instantaneous roll position.

The sections 12 and 14 have respective orientation sensors 22 and 24. The orientation sensors 22 and 24 communicate with one another so as to provide a common roll reference, to put the sections 12 and 14 on the same roll reference. More broadly, the communication between the sections 12 and 14 may be used to provide a common reference for the orientation of the sections 12 and 14. The use of a common reference for the sensors 22 and 24 allows commands from the control section sensor 24 to be translated for use in the guidance section 12, which relies on the guidance section sensor 22. The determination of an orientation reference allows the sections 12 and 14 to function properly together without the need to physically align the sections 12 and 14. The translation may be done by determining an alignment correction factor to be used in translating alignment information gathered The sensors 22 and 24 may be any of variety of "truth" sensors, sensors that provide orientation events that indicated a certain predetermined orientation in at least one direction. For example the sensors 22 and 24 may be magnetometers, sun sensors, UV sensors, IR sensors, or other truth sensors that provide an output that varies depending on the roll orientation of the sensor.

Figure 3:
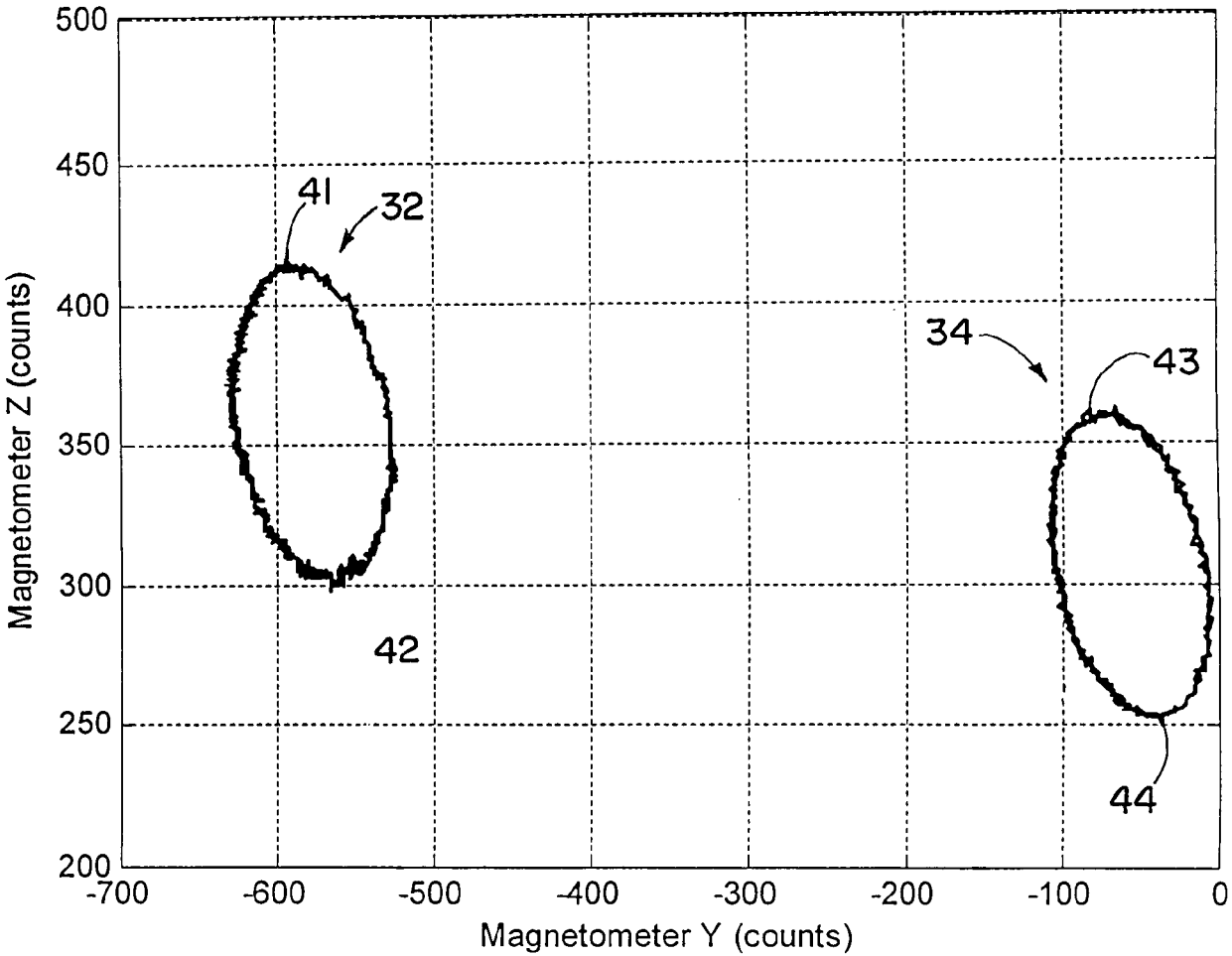
FIG. 3 is a plot showing magnetometer output of sensors used in an embodiment of the projectile of FIG. 1.

FIG. 3 shows a pair of output data traces 32 and 34 for a particular type of truth sensor, a magnetometer. The trace 32 shows the count output in Y and Z directions for the magnetometer in the guidance section 12, while the trace 34 shows the count output of the magnetometer in the control section 14. The traces 32 and 34 each show a different number of counts in both directions as the projectile goes through a roll cycle. It will be noted that the two traces 32 and 34 have similar shapes, although there is a bias change caused by any number of causes, including sensor calibration or sensor shift during launch of the projectile. In particular the roll orientations corresponding to maxima and minima of the traces 32 and 34, indicated as reference numbers 41 and 42 for the trace 32, and 43 and 44 for the trace 34, may be used as orientation events for providing a common roll reference.

Figure 4:
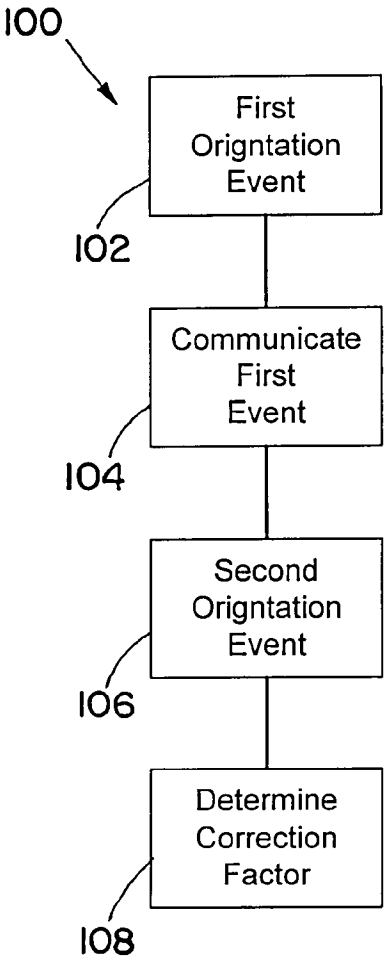
FIG. 4 is a high level flow chart showing steps of a method of determining a correction factor, in accordance with an embodiment of the invention.

FIG. 4 provides an overview of a method 100 of determining the alignment correction factor for use to provide a common reference to the sensors 22 and 24. In step 102 one of the sensors 22 and 24 experiences an orientation event, an orientation of that a sensor to a predetermined orientation, for example corresponding to a maximum or minimum of output. In step 104 the occurrence of the orientation event is communicated to the other sensor. The communication may be by a wired or wireless connection between the sensors 22 and 24. For example a wired communication may be by a wire or cable inside or outside of the projectile 10. Examples of wireless communication methods include UV beacons and RF band signaling. The information received at the other sensor may be stored at that other sensor, along with an indication of the reading or roll angle presently indicated by the other sensor.

The second sensor orientation event occurs at step 106. Finally, in step 108, a determination is made of the alignment correction factor for translating the readings from one sensor to the other sensor. For example, one of the sections may have noted its roll position when it received a communication regarding the occurrence of an orientation event at the other sensor, and may determine the correction merely by observing how far the one of the sections rolls before its corresponding orientation event occurs. The determination may be made by appropriate circuitry in the projectile, such as in one of the parts of the projectile, for example.

It will be appreciated that the order of the steps may differ from that shown in FIG. 4. For example the both of the orientation events may occur prior to communication between the sensors 22 and 24.

The exchange of information on the orientation events occurring at the sensors 22 and 24 provides logical clocking of the sensors 22 and 24 together. The logical clocking of the sensors 22 and 24 allows compensation for physical misalignment of the parts 12 and 14 of the projectile 10. Such physical misalignment may be a result of tolerances in assembly of the various parts of the projectile 10. Also physical misalignment may occur as a result of forces during launch (especially gun launching) and extreme maneuvering during flight. The use of logical clocking eliminates the need for physical clocking (alignment) of the different parts with their different sensors. The use of logical clocking as described above also allows the use of coupling mechanisms that would be difficult to apply physical clocking to, such as a screw-in navigation or guidance kit. The use of logical clocking allows faster and easier assembly, eliminating the need for precision testing and shimming in connecting in making connections between the parts 12 and 14 and other portions of the projectile 10.

The determination of a common "truth" reference and a correction factor allows for translation between misaligned sections 12 and 14. This allows the control section 14 to effectively provide commands to the guidance section 12. For example the correction factor may be added to or subtracted to a measured angle produced by the control section 14 for providing instructions to guidance section 12, for example in setting the configuration of canards or other control surfaces to keep the projectile 10 at a controlled angle. This allows the guidance section 12 to accurately act on instructions from the control section 14, even though the two sections 12 and 14 may have some misalignment between them, and thus different senses of roll orientation.

Figure 5:
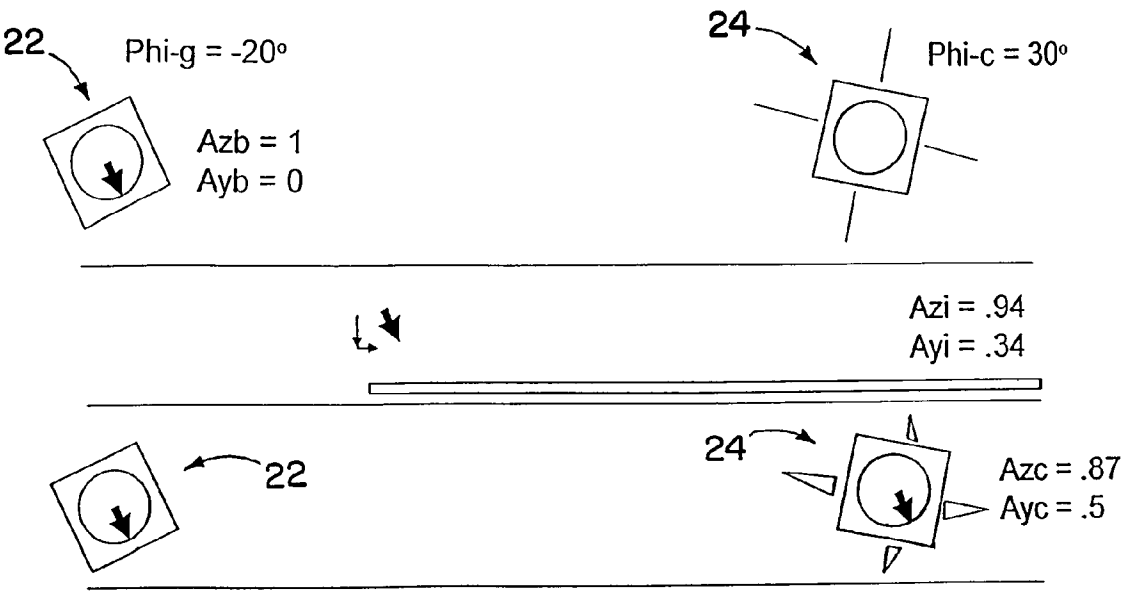
FIG. 5 is a diagram representing the transformation from a body based command into an inertial command.

FIG. 5 illustrates the process of translating a command from one clocked axis on the projectile 10 (FIG. 1) to an inertial axis system, and from there to another clock axis on the projectile 10. The top panel of FIG. 5 shows the guidance seeker or sensor 22 being clocked at an angle $\phi_g$ of −20 degrees relative to vertical, and the control sensor or seeker 24 being clocked at an angle $\phi_c$ of 30 degrees relative to vertical. In operation the guidance sensor 22 measures a maximum and transmits to the control sensor 24 the occurrence of this orientation event. The control section sensor 24 may then observe a 30 degree difference in orientation before it (the control section sensor 24) reached its maximum value. The control section 14 then will rotate any guidance command by −30 degrees to command in the proper seeker plane for use by the guidance section 12. This can be done in a simple one-step process, as described above.

Alternatively a two-step process may be used, as illustrated in FIG. 5. The first step is a conversion of a command from the body or guidance section axes (frame of reference) to an inertial frame of reference, a frame of reference which is fixed relative to the earth, for example. This is illustrated in the top two panels of FIG. 5. A command or acceleration $A_{Zb}$ and $A_{Yb}$ in guidance or body coordinates can be transferred to inertial coordinates using the following equations:

$$A_{Zi}=A_{Zb}\cos(\phi_g)+A_{Yb}\sin(\phi_g) \quad (1)$$

$$A_{Yi}=A_{Yb}\cos(\phi_g)-A_{Zb}\sin(\phi_g) \quad (2)$$

In the illustrated transformation an $A_{Zb}$ of 1 and $A_{Yb}$ of 0 are converted to an $A_z$, of 0.94 and an $A_{Yi}$ of 0.34.

As illustrated at the middle and bottom of FIG. 5, the system can then convert from the inertial coordinate system (inertial reference frame) to a control system coordinate system, accounting for the difference between the control system orientation (clocking) and the inertial system coordinate system. The transformation is made using the following equations:

$$A_{Zc}=A_{Zi}\cos(\phi_c)+A_{Yi}\sin(\phi_c) \quad (3)$$

$$A_{Yc}=A_{Yi}\cos(\phi_c)-A_{Zi}\sin(\phi_b) \quad (4)$$

In the illustrated example this results in a transformation to an $A_{Zc}$ of 0.87 and an $A_{Yc}$ of 0.5.

To recapitulate, the guidance section 12 determines what to do from measurements in its clocked coordinate system (guidance or body axes). The guidance section 12 uses its knowledge of the orientation of its clocked system relative to the inertial system (through the use of a truth sensor), to convert the command to the "universal" inertial coordinates. This converted form is what is sent to the control section 14. At the control section the commands in the inertial coordinate system are converted to the local clocked coordinate system of the control section 14. Because of gravity, many guidance laws operate in inertial space, so it is advantageous to have the command rotated out of body coordinates into inertial coordinates.

Figure 6:
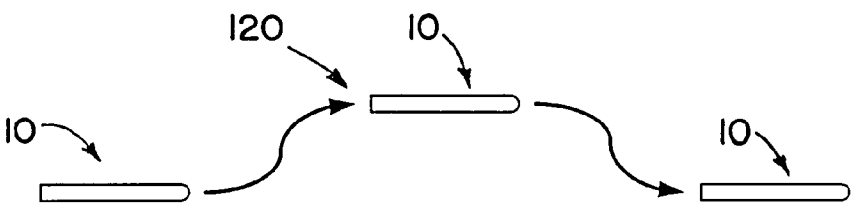
FIG. 6 is a diagram of an observabiltiy maneuver that may be performed in an embodiment of the present invention.

As discussed earlier, similar corrections or reference values may be obtained in other rotational directions. With reference to FIG. 6, the projectile 10 may be directed to an observability maneuver 120 after launch, in order to determine reference values for use in correcting or translating orientation values in other directions. In the illustrated embodiment the observability maneuver 120 is a observation maneuver that allows determination of additional pitch and yaw differences between the sensors 22 and 24 in the sections 12 and 14. The observation maneuver may follow a predetermined course, for example including a climb at a given angle, followed by a dive at a given angle, that allows comparison between outputs of the sensors 22 and 24. Corresponding reference alignment correction values may be determined from such differences. The sensors 12 and 14 may be three-axis magnetometers, and the use of the observability maneuver 120 may allow determination of reference correction values for the sensors 12 and 14 in all three directions. Other typical observability maneuvers that might be employed are pitch-ups, yaw wiggles, split S turns, and induced variations.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A method of projectile configuration and use comprising:

providing a first part of a projectile with a first sensor;

providing a second part of the projectile with a second sensor;

threadedly connecting the parts together at a threaded connection between the parts; and compensating for variations in roll alignment at the threaded connection between the parts, wherein the compensating includes:

communicating orientation information from the first part to the second part; and determining, in the second part, a roll alignment correction factor for correcting for a difference in the roll alignment between the first part and the second part.

2. The method of claim 1, wherein respective of the parts include a control system and a guidance system.

3. The method of claim 2, wherein the compensating further includes using the correction factor to translate commands from the guidance system coordinate system to a control system coordinate system.

4. The method of claim 2, wherein the control system provide instructions to guide the projectile, with the instructions acted on by the guidance system.

5. The method of claim 1, wherein the communicating the orientation information includes communicating information on an orientation event occurring at the first sensor.

6. The method of claim 5, wherein the orientation event includes the first part reaching a predetermined orientation.

7. The method of claim 6, wherein the predetermined orientation is the sensor facing vertically up.

8. The method of claim 5, wherein the orientation event includes the first sensor reaching a maximum or minimum output value.

9. The method of claim 5, further comprising the occurrence of a second orientation event at the second sensor; and wherein the determining includes taking the roll alignment correction factor as the difference between the orientation of the second sensor when the first orientation event occurs and the orientation of the second sensor when the second orientation event occurs.

10. The method of claim 9, wherein the roll alignment correction factor is a roll correction factor that is a difference of roll orientation of the second sensor between the first orientation event and the second orientation event.

11. The method of claim 9, further comprising putting the projectile into an observability maneuver before the occurrence of the orientation events, and maintaining the projectile in the observability maneuver during the orientation events.

12. The method of claim 1, wherein the communicating includes wired communicating between the parts.

13. The method of claim 1, wherein the communicating includes wireless communicating between the parts.

14. The method of claim 1, wherein the providing the parts with the sensors includes providing at least one of the parts with a magnetometer.

15. The method of claim 1, wherein the providing the parts with the sensors includes providing at least one of the parts with one of a sun sensor, an ultraviolet (UV) sensor, or an infrared (IR) sensor.

16. A projectile comprising:

a first part of a projectile with a first sensor;

a second part of the projectile with a second sensor;

a communication link for communicating orientation information from the first part to the second part; and means for determining, in the second part, a roll alignment correction factor for correcting for a difference in roll alignment between the first part and the second part.

17. The projectile of claim 16, wherein one of the first part of second part is coupled to a fuselage of the projectile without regard to roll clocking of the other of the first part or second part.

18. The projectile of claim 16, wherein the communication link is a wireless communication link.

19. The projectile of claim 16, wherein there is a threaded connection between the first part and the second part; and wherein respective of the parts include a control system and a guidance system, with the control system providing instructions to guide the projectile, with the instructions acted on by the guidance system.

* * * * *